US008672694B2

(12) United States Patent
Lee et al.

(10) Patent No.: US 8,672,694 B2
(45) Date of Patent: Mar. 18, 2014

(54) PROTECTION MODULE FOR DATA TRANSMISSION CONNECTOR

(75) Inventors: Kihai Lee, Taipei (TW); Jerry Su, Taipei (TW)

(73) Assignee: Hsing Chau Industrial Co., Ltd. (TW)

( * ) Notice: Subject to any disclaimer, the term of this patent is extended or adjusted under 35 U.S.C. 154(b) by 195 days.

(21) Appl. No.: 13/421,164

(22) Filed: Mar. 15, 2012

(65) Prior Publication Data

US 2013/0244459 A1 Sep. 19, 2013

(51) Int. Cl.
*H01R 13/443* (2006.01)

(52) U.S. Cl.
USPC ..... 439/133

(58) Field of Classification Search
None
See application file for complete search history.

(56) References Cited

U.S. PATENT DOCUMENTS 4,311,883 A * 1/1982 Kidney ..... 379/443
4,647,726 A * 3/1987 Blum ..... 379/435
4,740,168 A * 4/1988 Carney et al. ..... 439/133
5,288,241 A * 2/1994 Davidge et al. ..... 439/304
5,305,380 A * 4/1994 Hileman et al. ..... 379/445
5,556,295 A * 9/1996 McFadden et al. ..... 439/301
6,067,014 A * 5/2000 Wilson ..... 340/540
6,309,247 B1 * 10/2001 Wang ..... 439/521
8,112,879 B2 * 2/2012 Morrison et al. ..... 29/764
8,215,972 B2 * 7/2012 Wang ..... 439/172
8,323,042 B2 * 12/2012 Lin ..... 439/135
8,512,061 B2 * 8/2013 Morrison et al. ..... 439/344
2007/0020976 A1 * 1/2007 Tirtosupono ..... 439/133

* cited by examiner

*Primary Examiner* — Neil Abrams
(74) *Attorney, Agent, or Firm* — Schmeiser, Olsen & Watts, LLP

(57) ABSTRACT

A protection module includes a protective cover having a first main body and an elastic arm, and a cover removing tool having a second main body, at least one elastic engaging pin and a release pin. The first main body has at least one engaging slot and a retaining slot; the elastic arm has a free front end with at least one beveled slot. The release pin is longer than the elastic engaging pin and has a thickness larger than a height of two raised portions in a socket of the data transmission connector, and has an acute-angled beveled free end. The elastic engaging pin has a cross-sectional shape corresponding to the engaging slot and has a free end with a retaining block. The protective cover is plugged into the data transmission connector for protecting the same against damages caused by maliciously applied force or improper use of it.

8 Claims, 9 Drawing Sheets

PROTECTION MODULE FOR DATA TRANSMISSION CONNECTOR

FIELD OF TECHNOLOGY

The present invention relates to a protection module for data transmission connector, and more particularly to a protection module for protecting a data transmission connector against damages caused by maliciously applied force or improper use of it.

BACKGROUND

The highly advanced technological fields bring on the quick development of networks. To use different networks, a large quantity of data transmission connectors is required. In the early stage of setting up networks, the data transmission connectors for accessing to the networks were not provided with any protective covers and were therefore subject to damages caused by invaded foreign matters or unauthorized use of them. It is therefore tried by the inventor to develop a protection module for data transmission connector, so as to protect a data transmission connector against damages caused by maliciously applied force or improper use of it.

SUMMARY

A primary object of the present invention is to provide a protection module for data transmission connector, so that the data transmission connector is protected against damages caused by maliciously applied force or improper use of it.

To achieve the above and other objects, the protection module according to the present invention is used to protect a data transmission connector that has a socket and two raised portions located at two lateral sides of an opening of the socket to space from each other. The protection module includes a protective cover having a first main body and an elastic arm, and a cover removing tool having a second main body, at least one elastic engaging pin and a release pin. The first main body has at least one engaging slot and a retaining slot located in the engaging slot at a rear side thereof; and the elastic arm is located outside the first main body and is provided at a free front end with at least one beveled slot. The protective cover is used to plug into the socket of the data transmission connector with the free end of the elastic arm pressed against a rear side of the two raised portions. The elastic engaging pin and the release pin are provided on the second main body. The release pin has a length larger than or equal to a length of the elastic engaging pin and a thickness larger than or equal to a height of the two raised portions in the socket of the data transmission connector, and is provided at a free end with an acute-angled beveled end. The elastic engaging pin has a cross-sectional shape corresponding to the shape of an opening of the engaging slot and is provided at a free end with a retaining block. The release pin is adapted to insert into the socket from between the two raised portions with the acute-angled beveled end of the release pin pressed against the beveled slot on the elastic arm to deform the elastic arm, so that the elastic arm can be separated from the two raised portions. The elastic engaging pin is adapted to insert into the engaging slot; and the retaining block is adapted to abut on the retaining slot.

By plugging the protective cover into the socket of the data transmission connector, the latter can be protected against damages caused by maliciously applied force or improper use of it.

BRIEF DESCRIPTION

The structure and the technical means adopted by the present invention to achieve the above and other objects can be best understood by referring to the following detailed description of the preferred embodiments and the accompanying drawings, wherein FIG. 1 is an exploded perspective view of a protection module for data transmission connector according to an embodiment of the present invention;

DETAILED DESCRIPTION

The present invention will now be described with a preferred embodiment thereof and with reference to the accompanying drawings.

Figure 1:
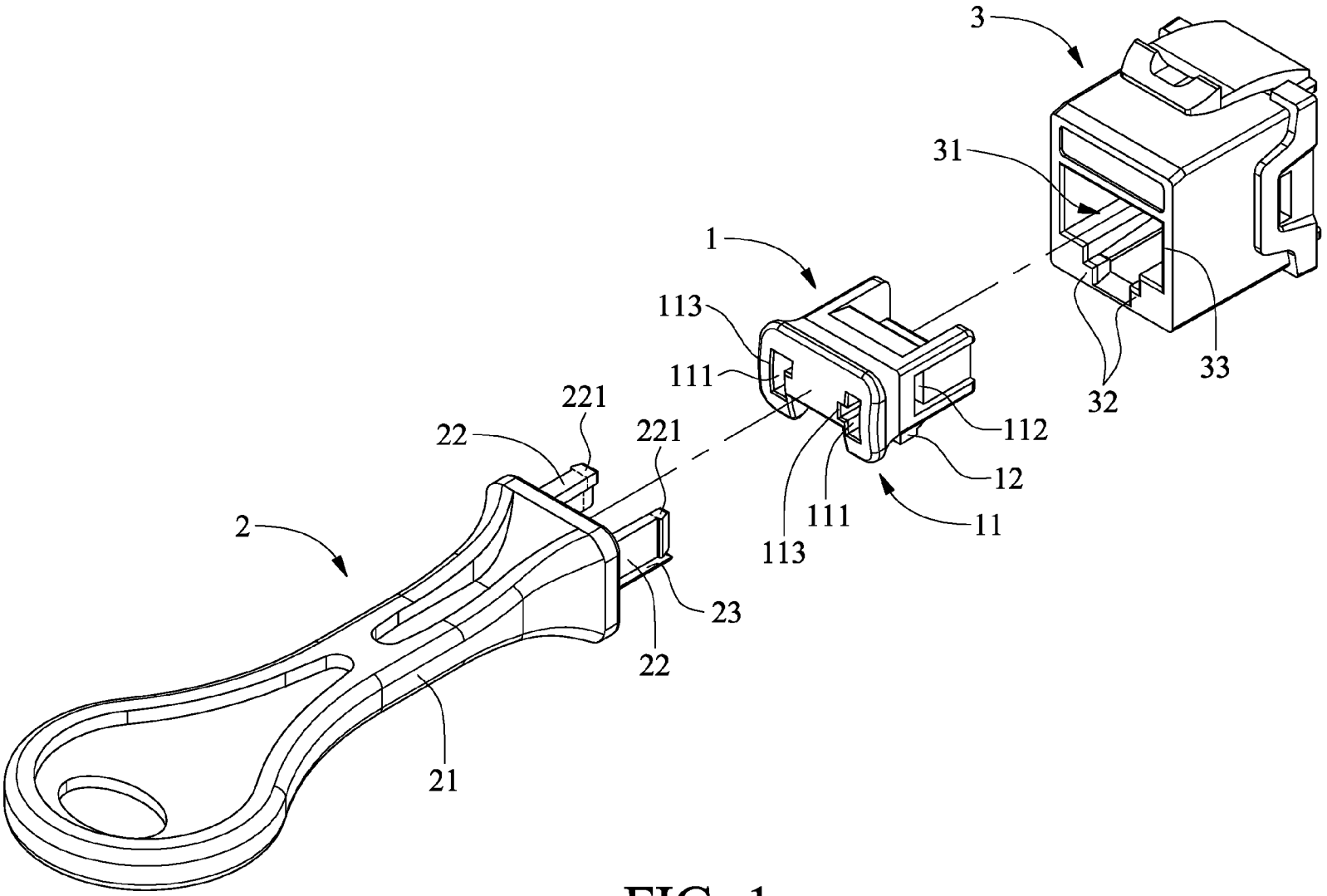
Figure 2:
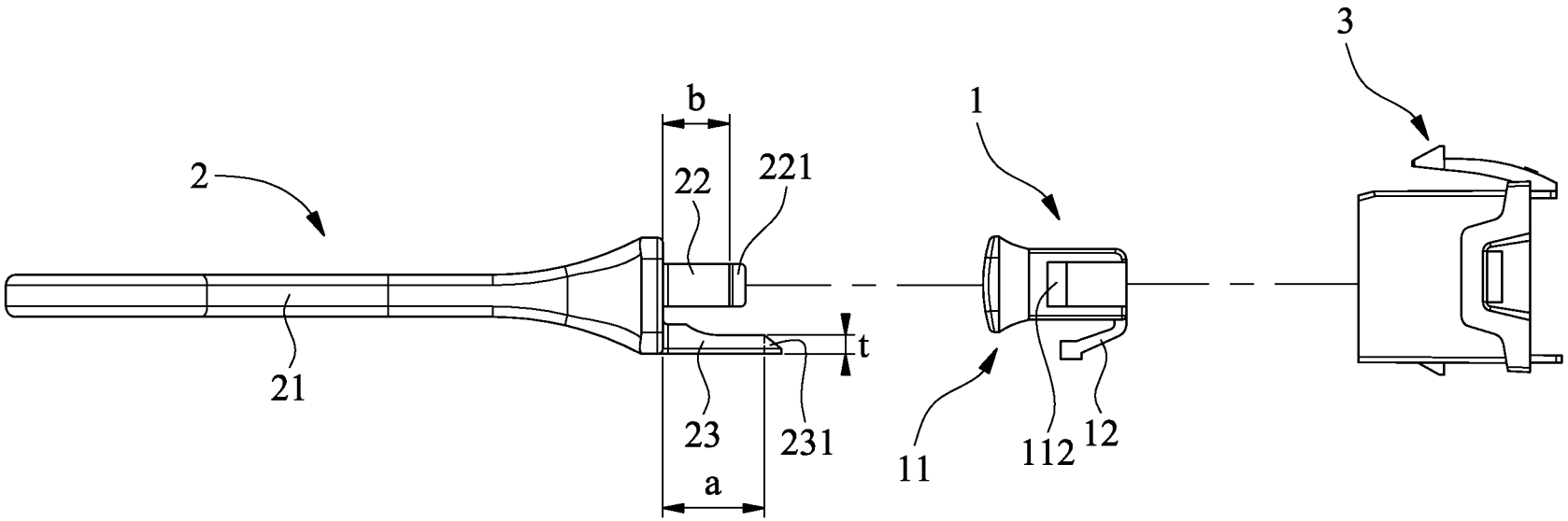
FIG. 2 is a side view of FIG. 1.
Figure 3A:
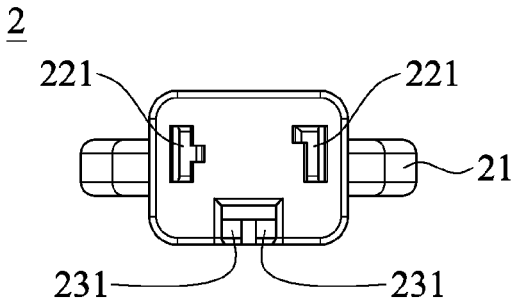
FIG. 3A, 3B and 3C are front views of a cover removing tool, a protective cover, and a data transmission connector, respectively, shown in FIG. 1.
Figure 3B:
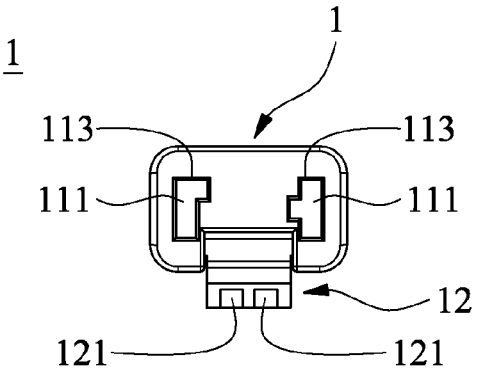
Figure 3C:
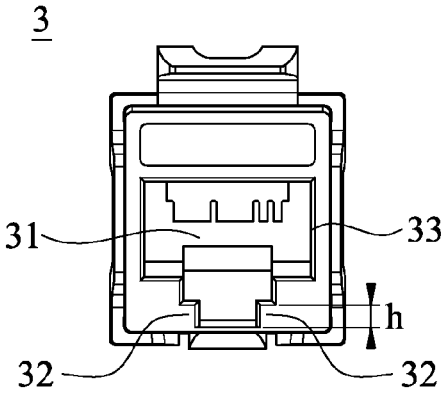

Please refer to FIGS. 1 and 2 that are exploded perspective and side views, respectively, of a protection module for data transmission connector according to an embodiment of the present invention. As shown, the protection module of the present invention includes a protective cover 1 and a cover removing tool 2; and a data transmission connector 3 to be protected by the protection module of the present invention includes a socket 31 and two raised portions 32 located at two lateral sides of an opening 33 of the socket 31 to space from each other. Please also refer to FIGS. 3A to 3C that are front views of the cover removing tool 2, the protective cover 1, and the data transmission connector 3, respectively.

The protective cover 1 has a first main body 11 and an elastic arm 12. The first main body 11 is provided with at least one engaging slot 111. In the illustrated embodiment, two engaging slots 111 having two differently shaped openings 113 are shown. The protective cover 1, once plugged into the data transmission connector 3, is removable from the data transmission connector 3 only with a cover removing tool 2 that can be engaged with the two engaging slots 111. By providing two engaging slots 111 have differently shaped openings 113, an enhanced protection can be provided to the data transmission connector 3. For example, the openings 113 of the engaging slots 111 can be E-shaped, F-shaped, L-shaped or T-shaped. The first main boy 11 is also provided with a retaining slot 112 located in the engaging slots 111 at a rear side thereof. In the illustrated embodiment, the retaining slot 112 is exposed to an outer side. However, in another embodiment, the retaining slot 112 may be otherwise invisibly provided in the engaging slots 111. The elastic arm 12 is located outside the first main body 11 and is provided at a free front end thereof with at least one beveled slot 121. In the illustrated embodiment, there are shown two beveled slots 121. The elastic arm 12 is forward and downward extended from a lower rear end of the first main body 11 toward a front side thereof. The elastic arm 12 can be integrally formed with the first main body 11.

Figure 4:
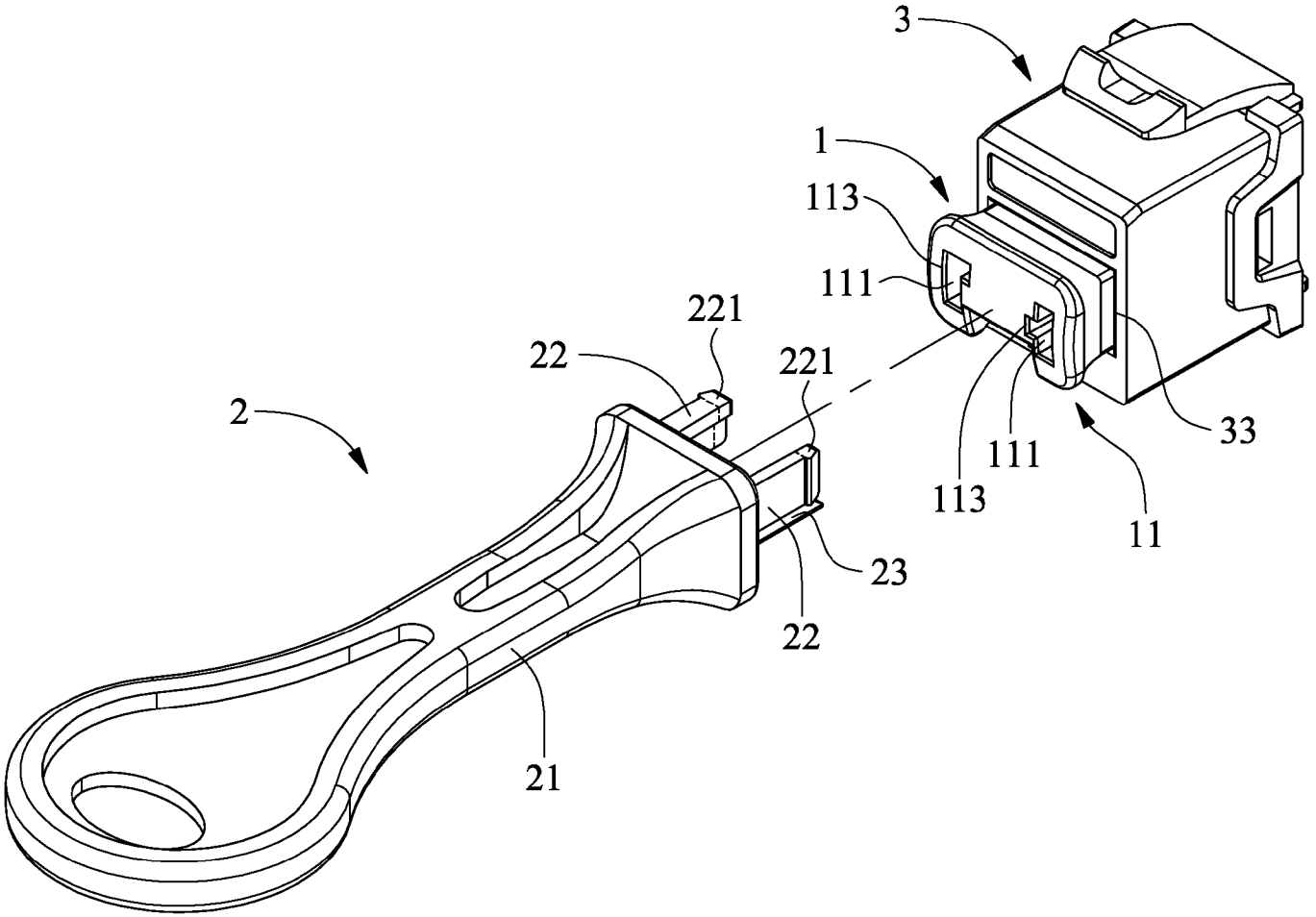
FIG. 4 is a partially assembled perspective view of FIG. 1 with a protective cover of the protection module retained to the data transmission connector.
Figure 5:
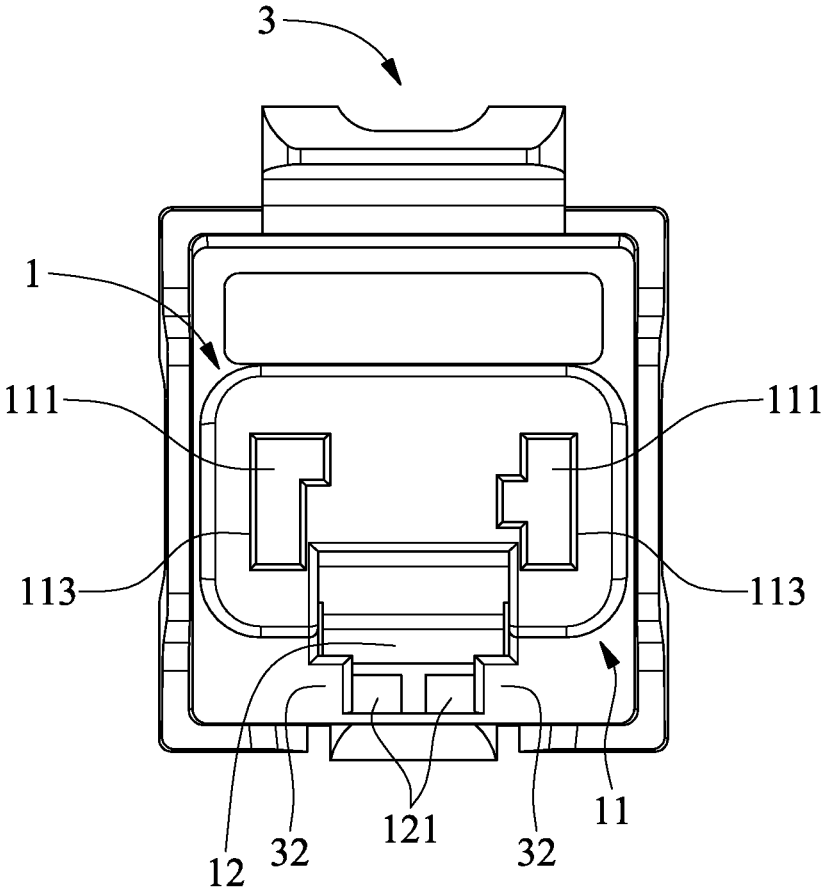
FIG. 5 is a front view of the data transmission connector with the protective cover retained thereto.
Figure 6:
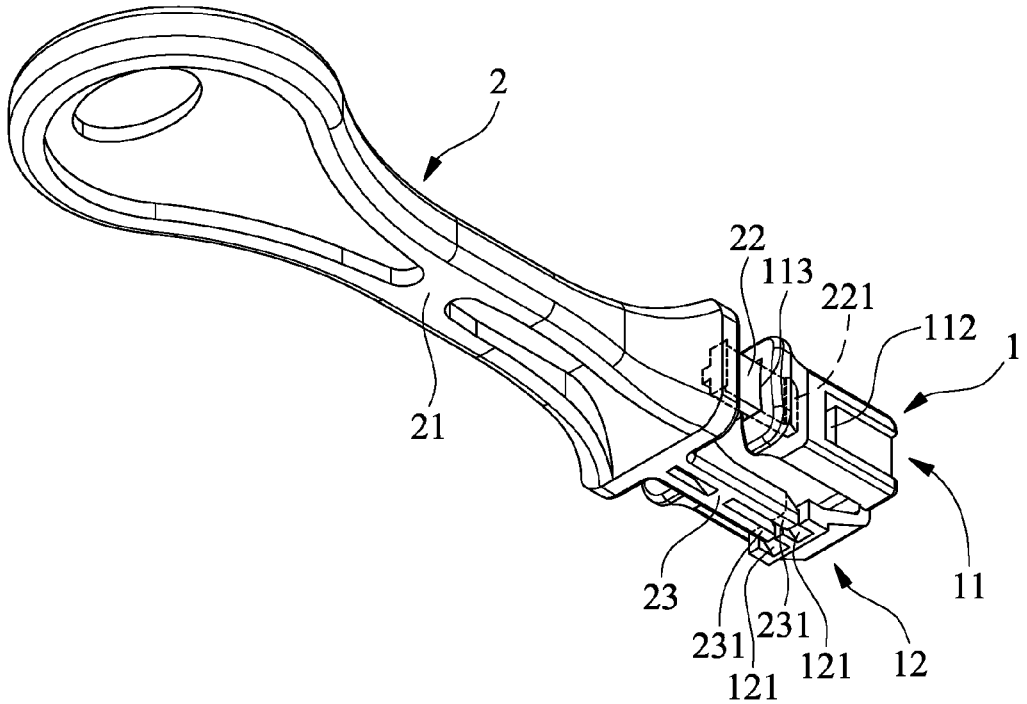
FIGS. 6 to 9 illustrate the use of the cover removing tool of the protection module of the present invention to remove the protective cover from the data transmission connector.
Figure 7:
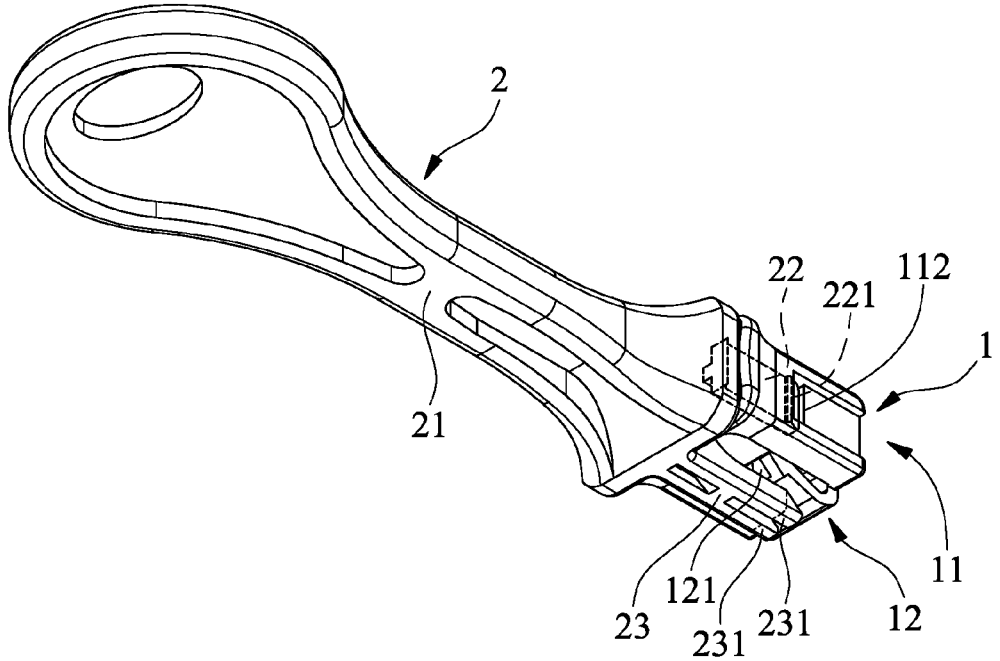
Figure 8:
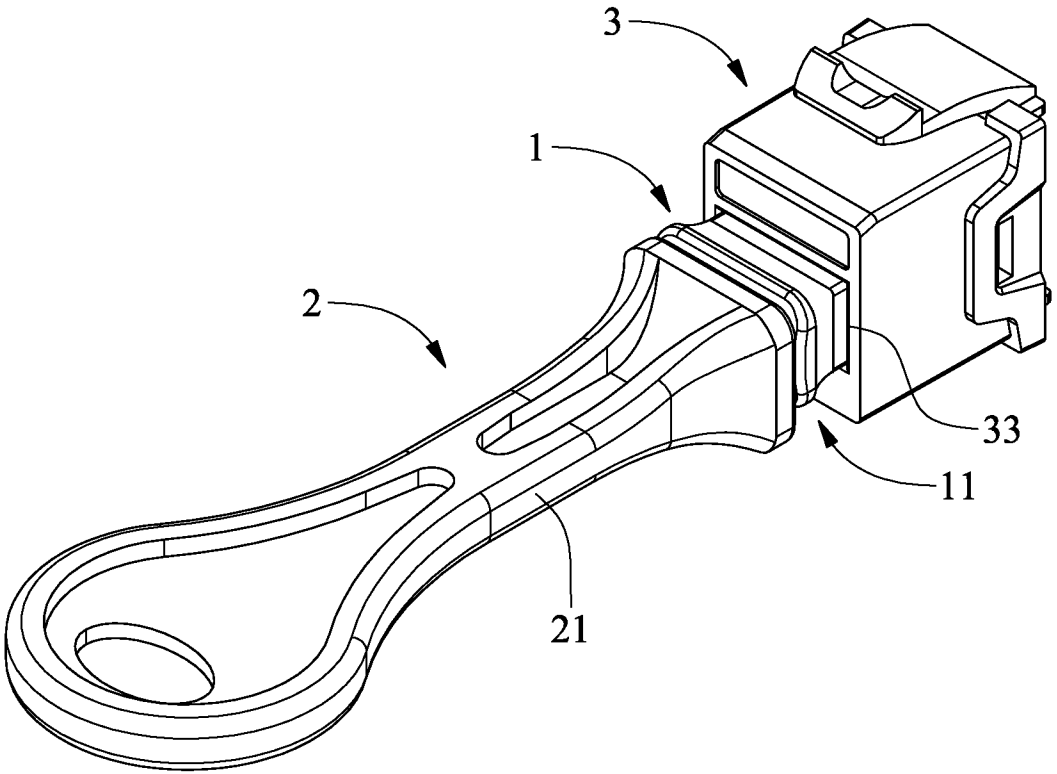
Figure 9:
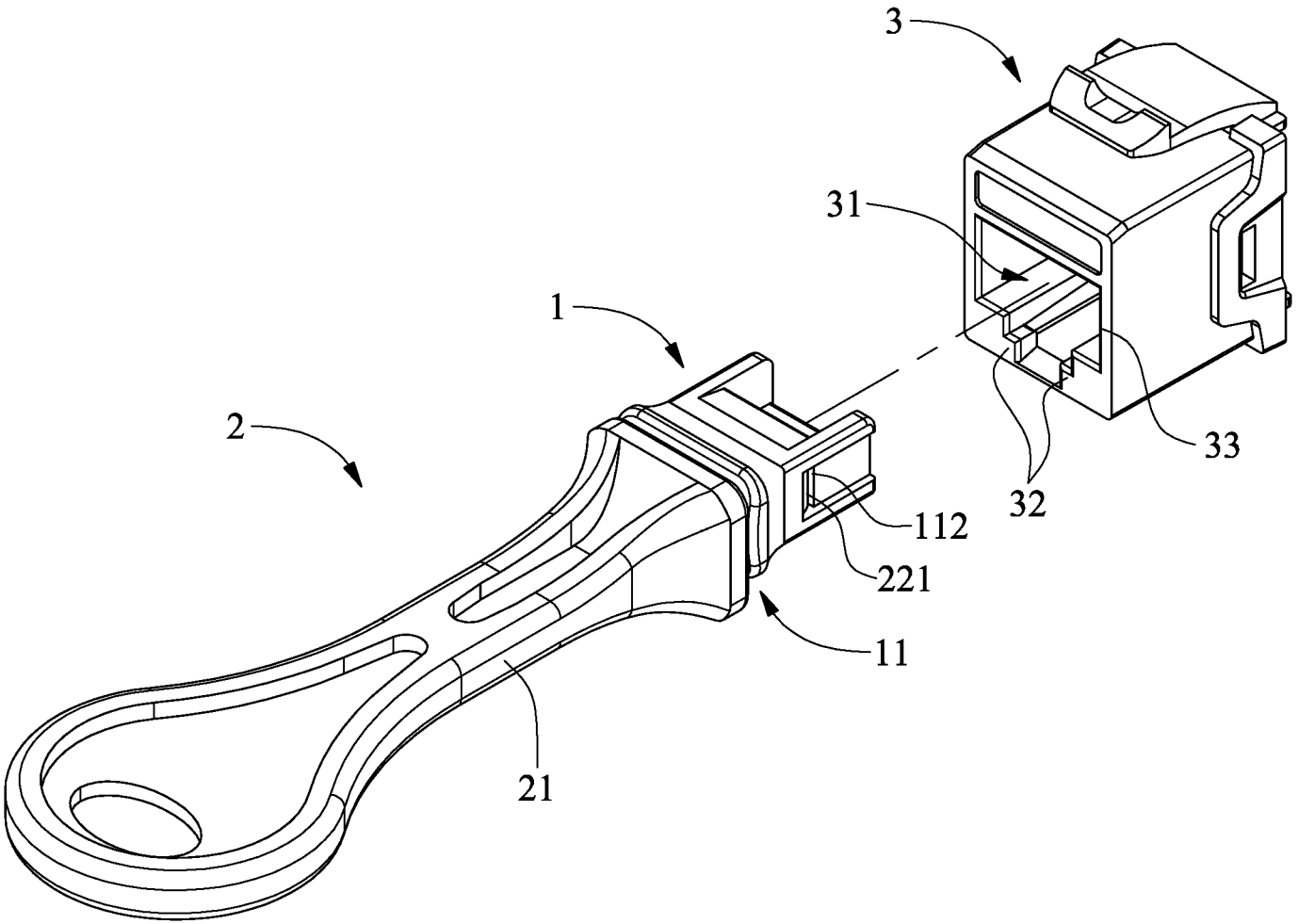

Please also refer to FIGS. 4 and 5 that are assembled perspective and front views, respectively, showing the protective cover 1 of the protection module is retained to the data transmission connector 3. When the protective cover 1 is plugged into the socket 31, a rear end of the elastic arm 12 will contact with the two raised portions 32 first. Then, the free front end of the elastic arm 12 is pressed against and pushed upward by the two raised portions 32. When the free front end of the elastic arm 12 is moved to a position in the socket 31 behind the two raised portions 32, the elastic arm 12 will elastically restore its original non-compressed state with its free front end abutted on a rear side of the raised portions 32, such that the protective cover 1 is retained in the socket 31 and accordingly protects the data transmission connector 3 against damages due to maliciously applied force or improper use of it.

The cover removing tool 2 has a second main body 21, at least one elastic engaging pin 22, and a release pin 23. In the illustrated embodiment, there are shown two elastic engaging pins 22. The elastic engaging pins 22 and the release pin 23 are provided on the second main body 21, and can be integrally formed with the second main body 21. As can be most clearly seen from FIG. 2, the release pin 23 has a length 'a' larger than or equal to a length 'b' of the elastic engaging pins 22; and as can be seen from FIGS. 2 and 3C, the release pin 23 has a thickness 't' larger than or equal to a height 'h' of the two raised portions 32. The elastic engaging pins 22 have cross-sectional shapes corresponding to those of the openings 113 of the engaging slots 111, so that the elastic engaging pins 22 can be inserted into the engaging slots 111. To provide enhanced protection, the elastic engaging pins 22 are further provided at respective free end with a retaining block 221, and the release pin 23 is provided at a free end thereof with at least one beveled end 231 at an acute angle.

Please refer to FIGS. 6 to 9 that show the use of the cover removing tool 2 to remove the protective cover 1 from the socket 31 of the data transmission connector 3. When the release pin 23 is inserted into the socket 31 from between the two raised portions 32, the retaining blocks 221 of the elastic engaging pins 22 are pressed by the edges of the openings 113 of the engaging slots 111, bringing the elastic engaging pins 22 to elastically deform and slightly move inward toward each other to thereby insert into the engaging slots 111. Since the release pin 23 has a length 'a' larger than or equal to the length 'b' of the elastic engaging pins 22, and since the release pin 23 has a thickness 't' larger than or equal to the height 'h' of the two raised portions 32, the acute-angled beveled end 231 of the release pin 23 will contact with and press against the beveled slots 121 of the elastic arm 12 first, such that elastic arm 12 is deformed to separate from the two raised portions 32. That is, the acute-angled beveled end 231 of the release pin 23 will contact with and press against the beveled slots 121 of the elastic arm 12 first, such that the free front end of the elastic arm 12 is raised to a position higher than the two raised portions 32. Thereafter, the elastic engaging pins 22 elastically restore to their original non-deformed state, so that the retaining blocks 221 are abutted on the retaining slot 112. Then, pull the second main body 21 outward, and the protective cover 1 can be removed from the socket 31 of the data transmission connector 3. With the above arrangements, the protection module of the present invention not only protects the data transmission connector 3 against damages caused by maliciously applied force or improper use of it, but also enables removal of the protective cover 1 from the data transmission connector 3, allowing a user to access the latter.

Figure 10:
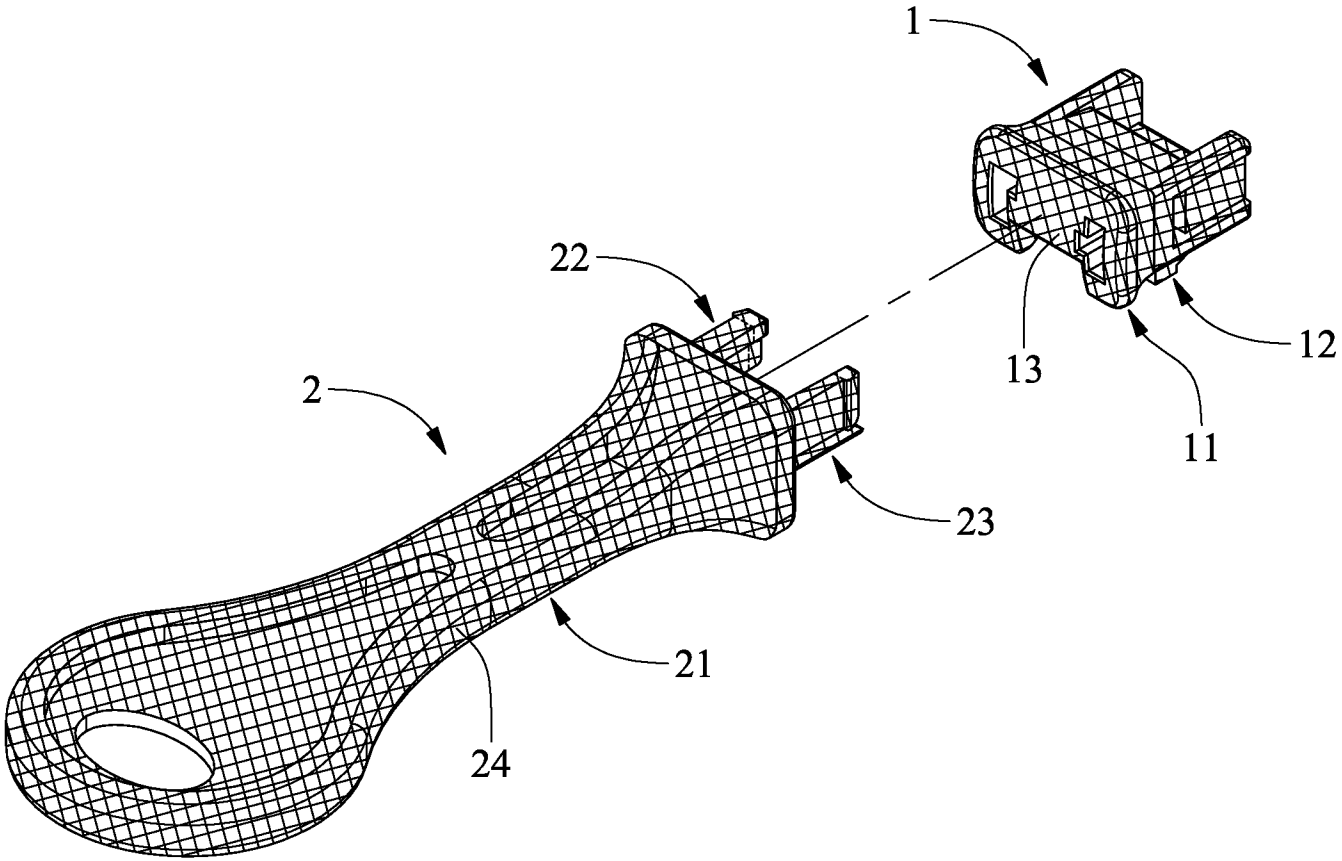
FIG. 10 is an exploded perspective view of the present invention showing the protective cover and the cover removing tool are coated with a color layer.

FIG. 10 is an exploded perspective view of the present invention showing the protective cover 1 and the cover removing tool 2 are respectively coated with a color layer. As shown, the protective cover 1 can be coated with a first color layer 13, and the cover removing tool 2 can be coated with a second color layer 24. The first color layer 13 is coated on outer surfaces of the first main body 11 and the elastic arm 12; and the second color layer 24 is coated on outer surfaces of the second main body 21, the elastic engaging pins 22, and the release pin 23. The first color layer 13 and the second color layer 24 are the same in color, so that a user may recognize from the color layers 13, 24 which data transmission connector is to be used with the protection module.

The present invention has been described with a preferred embodiment thereof and it is understood that many changes and modifications in the described embodiment can be carried out without departing from the scope and the spirit of the invention that is intended to be limited only by the appended claims.

What is claimed is:

1. A protection module for data transmission connector, the data transmission connector having a socket and two raised portions located at two lateral sides of an opening of the socket to space from each other, comprising:

a protective cover having a first main body and an elastic arm; the first main body having at least one engaging slot and a retaining slot located in the engaging slot at a rear side thereof; the elastic arm being arranged outside the first main body and being provided at a free front end with at least one beveled slot; the protective cover being adapted to plug into the socket with the free front end of the elastic arm abutted on a rear side of the two raised portions; and a cover removing tool having a second main body, at least one elastic engaging pin, and a release pin; the elastic engaging pin and the release pin being provided on the second main body; the release pin having a length larger than or equal to a length of the elastic engaging pin, and a thickness larger than or equal to a height of the two raised portions; the elastic engaging pin having a cross-sectional shape corresponding to a shape of an opening of the engaging slot, and being provided at a free end thereof with a retaining block; the release pin being provided at a free end thereof with at least one beveled end at an acute angle, and being adapted to insert into the socket from between the two raised portions with the acute-angled beveled end of the release pin pressed against the beveled slot on the elastic arm to deform the elastic arm, so that the elastic arm is separated from the two raised portions; the elastic engaging pin being adapted to insert into the engaging slot; and the retaining block being adapted to abut on the retaining slot.

2. The protection module as claimed in claim 1, wherein the protective cover is coated with a first color layer and the cover removing tool is coated with a second color layer; the first color layer being coated on outer surfaces of the first main body and the elastic arm, and the second color layer being coated on outer surfaces of the second main body, the elastic engaging pins and the release pin; and the first color layer and the second color layer being the same in color.

3. The protection module as claimed in claim 1, wherein the opening of the engaging slot can be E-shaped, F-shaped, L-shaped or T-shaped.

4. The protection module as claimed in claim 2, wherein the opening of the engaging slot can be E-shaped, F-shaped, L-shaped or T-shaped.

5. The protection module as claimed in claim 1, wherein the elastic arm is forward and downward extended from a lower rear end of the first main body toward a front side thereof.

6. The protection module as claimed in claim 2, wherein the elastic arm is forward and downward extended from a lower rear end of the first main body toward a front side thereof.

7. The protection module as claimed in claim 3, wherein the elastic arm is forward and downward extended from a lower rear end of the first main body toward a front side thereof.

8. The protection module as claimed in claim 4, wherein the elastic arm is forward and downward extended from a lower rear end of the first main body toward a front side thereof.

* * * * *